United States Patent [19]

Smith

[11] 4,146,992

[45] Apr. 3, 1979

[54] VEHICLE WITH STUFFED WHEEL, AND METHOD OF MAKING

[76] Inventor: Marjorie A. M. Smith, 7929 Stewart & Gray #10, Downey, Calif. 90241

[21] Appl. No.: 691,451

[22] Filed: Jun. 24, 1976

[51] Int. Cl.[2] ..... A63H 17/26

[52] U.S. Cl. ..... 46/221; 29/159 R; 29/159.1; 301/63 C; 152/312; 156/121

[58] Field of Search ..... 46/201, 221; 301/63 C, 301/63 PW; 152/311-314, 310, 323; 29/159.1, 159 R; 156/112, 118, 121

[56] References Cited

U.S. PATENT DOCUMENTS

| | | | |
|---|---|---|---|
| 472,484 | 4/1892 | Phelps | 152/311 |
| 1,476,878 | 12/1923 | Dessau | 152/310 |
| 1,913,422 | 6/1933 | Wikle | 156/121 |
| 3,264,780 | 8/1966 | Doe | 46/221 |
| 3,445,958 | 5/1969 | Johnson et al. | 46/221 |

*Primary Examiner*—E. Barry Shay
*Attorney, Agent, or Firm*—Boniard I. Brown

[57] ABSTRACT

A wheeled toy with at least one wheel having a hollow thin-walled pliant toroidal tube formed from a piece of thin flexible material such as fabric and containing a relatively rigid sleeve disposed within the tube interior in surrounding relation to the inner annular wall portion of the toroid and soft spongy stuffing material, such as cotton. The wheel is rotatably mounted on the toy body by means of an axle extending through the central openings in the toroid and sleeve. A method of fabricating the wheel.

16 Claims, 7 Drawing Figures

VEHICLE WITH STUFFED WHEEL, AND METHOD OF MAKING

BACKGROUND OF THE INVENTION

1. Field of the Invention

This invention relates generally to wheeled toys and more particularly to a novel soft wheel construction for such toys and to a novel method of fabricating the wheel.

2. Prior Art

Wheeled toys have long been a favorite with children and, as a consequence, the prior art is replete with a vast assortment of such toys and methods for their fabrication. Recently, substantially increased emphasis has been placed on product safety in general and, in particular, on eliminating the inherent safety hazzards of toys, especially those intended for use by relatively young children. This emphasis, in turn, has resulted in an increasing demand for "soft" toys, that is toys which are relatively soft or pliant such that they are virtually incapable of causing injury to a child. Aside from the safety consideration, soft toys also have special appeal to infants and young children.

SUMMARY OF THE INVENTION

According to one of its aspects, this invention provides a novel soft wheel construction for wheeled toys, such as toy wheeled vehicles and the like and a novel method of fabricating the wheel. The soft wheel has a hollow thin-walled pliant toroidal tube constructed of a thin pliant sheet-like material such as fabric. This tube forms a toroid with the central opening bounded circumferentially by an inner annular wall portion of the toroid. Contained within the tube interior in surrounding relation to the inner annular boundary wall portion of the toroid is a relatively rigid sleeve constructed of plastic or other suitable material. A relatively soft and spongy stuffing material, such as cotton, fills the annular interior space of the tube about the sleeve.

A wheeled toy embodying the wheel has a body on which the wheel is rotatably mounted by means of an axle extending through the central opening of the wheel with the inner annular wall portion of the wheel tube disposed between the axle and the wheel tube. The particular toy described is a wheeled vehicle having four wheels, each rotatably mounted on an axle which is non-rotatably secured to vehicle body. In this case, the sleeve of each wheel is internally sized to receive the wheel axle with sufficient clearance to rotate freely on the axle with the inner annular wall portion of the wheel tube disposed between the axle and sleeve. It is considered to be within the scope of the invention, however, to have the wheel fit non-rotatably on the axle and rotatably mount the axle on the body.

Another aspect of the invention is concerned with a novel method of fabricating the soft wheel according to the invention, the wheel is fabricated by providing a rectangular piece of pliant or flexible thin sheet-like material such as fabric and drawing this piece of material through and about the wall of the wheel sleeve into an open ended annular tubular configuration having an annular centerline encircling the sleeve axis, a first pair of opposite edges of the material encircling the sleeve axis in contiguous relation to one another, and a second pair of opposite edges of the material encircling the tube centerline in contiguous relation to one another and defining confronting open ends of the tube. The wheel is completed by stuffing the tube and joining the contiguous edges of the tube material by stitching or the like. The row of stitching encircling the sleeve axis may be concealed by a simulated hub-cap-like disc on the wheel axle. The piece of fabric or other material from which the tube is formed may have light and dark sections which are positioned in the completed wheel to simulate the sidewalls and tread of an actual vehicle tire.

DESCRIPTION OF THE PREFERRED EMBODIMENT

Figures 1, 2, 3, 4, 5, 6, 7:
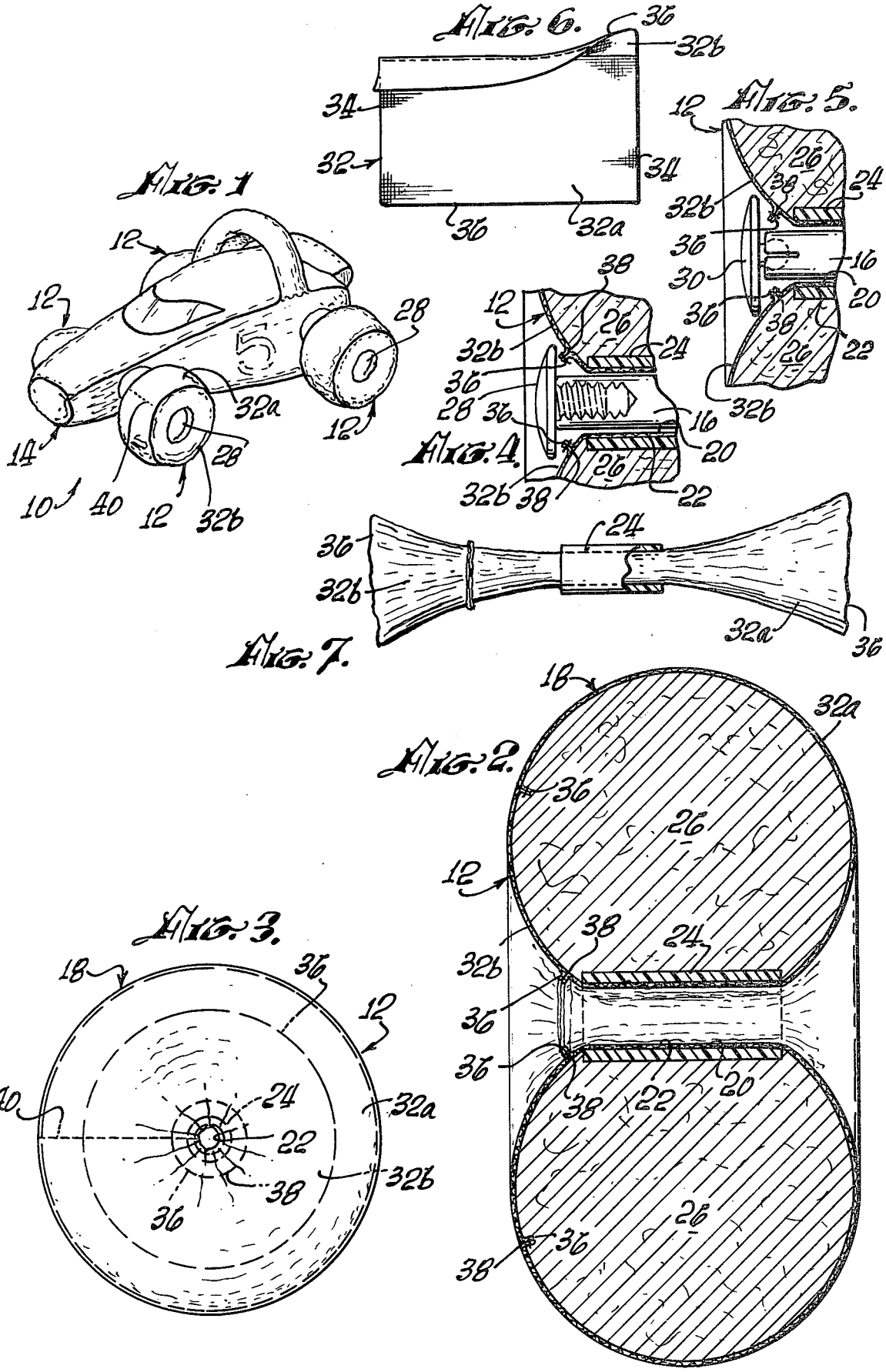
FIG. 1 is a perspective view of a toy wheeled vehicle embodying soft wheels according to the invention.
FIG. 2 is an enlarged section through one of the wheels of the vehicle.
FIG. 3 is a side view in reduced scale of the inner side of the wheel.
FIG. 4 is an enlarged fragmentary section illustrating the manner in which the wheel is mounted on the vehicle.
FIG. 5 is a section similar to FIG. 3 illustrating a modified wheel mounting means.
FIG. 6 illustrates a piece of sheet-like material, such as fabric, which is used in making the wheel.
FIG. 7 illustrates certain steps involved in making the wheel.

Turning first to FIG. 1, there is illustrated a wheeled toy 10, in this instance a toy wheeled vehicle, embodying wheels 12 according to the invention. The toy which has a simulated vehicle body 14 which may be a soft body fabricated from fabric, sheet plastic or the like and stuffed with a pliant spongy material, such as cotton or, alternatively, a relatively rigid body of molded plastic, wood or other suitable material. Each wheel 12 is rotatably mounted on the body 14 by means of an axle 16. As will appear from the ensuing description, the wheels may rotate on the axles or the wheels and axles may rotate together.

The primary contribution of the invention resides in the construction of the wheels 12 which will now be described by reference to FIGS. 2–7. The four wheels of the toy vehicle are essentially identical and hence a description of one will suffice for all. Each wheel comprises a hollow thin-walled pliant toroidal tube 18 having a central opening 20 bounded circumferentially by an inner annular wall portion 22 of the tube. This tube is formed in a manner to be explained presently and may comprise any thin pliant or flexible material such as fabric, plastic film or the like. In the following description, it will be assumed that the tube comprises a fabric material. Contained within the hollow annular interior of the tube 18 in surrounding relation to its inner wall portion 22 and hence also in surrounding relation to its central opening 20 is a relatively rigid sleeve 24. The material of this sleeve may be plastic, wood, metal or other suitably rigid material. Filling the interior of the tube 18 about the sleeve 24 is a pliant or spongy stuffing material 26 which retains the tube in its toroidal tube shape.

As mentioned earlier, each wheel 12 is rotatably mounted on the toy vehicle body 14 by means of an axle 16. In the particular inventive embodiment illustrated, the axle 16 is a wooden or plastic dowell or rod which may be fixed to or formed integrally with the body. This axle extends through the central opening 20 of the tube 18 and through the surrounding sleeve 24, such that the inner tube wall portion 22 is disposed between the axle and sleeve. The sleeve is internally sized to provide sufficient clearance for the tube wall portion 22 to enable the wheel 12 to turn freely on the axle. The wheel is retained on the axle either by a large headed screw 28 (FIG. 4) or a large-headed snap fastener 30 (FIG. 5). While the particular wheel arrangement illustrated provides for rotation of the wheel on the axle, it is evident that the wheel may be non-rotatably fixed on the axle which, in turn, may turn relative to the toy body.

Another aspect of the invention is concerned with a novel method of making the wheel 12. According to this aspect of the invention, the wheel tube 18 is made from a rectangular piece 32 of sheet material, shown in FIG. 6. As noted earlier, this sheet material is assumed to be fabric but may comprise plastic or other suitable material. The sheet material is rolled into a cylindrical form about an axis parallel to the shorter material edges 34 and is inserted through the wheel sleeve 24, as shown in FIG. 7. The exposed longer edge portions 36 of the material are then drawn together about the sleeve into a tubular configuration containing the sleeve, and the longer edges are then stitched together or otherwise joined along a generally annular junction 38, which in this case is shown as an outwardly turned seam formed by an annular row of stitching, encircling the wheel axis at a position close to sleeve 24 (see FIGS. 2, 4, 5). The sheet material, when thus stitched, effectively forms an open ended toroidal tube containing and surrounding the sleeve 24 and having confronting open ends surrounded by the shorter material edges 34. These shorter edges are joined by an annular row of stitching 40 surrounding the annular centerline of the tube or in some other way to complete the tube 18.

As noted earlier, the tube 18 is stuffed with a compliant stuffing material 26, such as cotton. This stuffing material may be inserted through the open ends of the tube prior to joining these ends by the stitching 40 or through the side of the tube prior to completion of the stitching 38.

According to the preferred practice of the invention, the stitching 38 is located close to the center of the wheel so as to be covered and concealed by the head of screw 28 or fastener 30. The tube sheet material 32 may be a solid color or it may have a white portion **32*a* and a black portion 32*b* which are located, as shown in FIG. 2, such that the black portion simulates a tire tread and the white portion simulates a white tire side wall. These differently color portions may be provided by coloring a single piece of sheet material or by stitching together two differently colored pieces of sheet material, as shown. In FIGS. 6 and 7, portion 32*b* represents a piece sewed onto the end of portion 32*a*. Inturned seam 36, FIG. 2, represents the seam between 32*a* and 32*b*** in the finished wheel.

The inventor claims:

1. A wheeled toy comprising:

a body, at least one wheel comprising a hollow thin-walled pliant toroidal tube having a central opening bounded circumferentially by an inner annular wall portion of said tube, a relatively rigid sleeve contained within the interior of said tube in surrounding relation to said inner annular wall portion, and a pliant stuffing material filling said tube interior about said sleeve, and means rotatably mounting said wheel on said body for rotation about the axis of said central tube opening including an axle secured to said body and extending through said central opening in supporting relation to said sleeve with said inner annular wall portion disposed between said axle and sleeve.

2. A toy according to claim 1 wherein:

the wall of said tube comprises a thin flexible sheet-like material such as fabric.

3. A toy according to claim 1 wherein:

said stuffing material comprises a relatively soft spongy material such as cotton.

4. A toy according to claim 3 wherein:

the wall of said tube comprises a thin flexible sheet-like material such as fabric.

5. A toy according to claim 1 wherein:

said tube has an annular center line and comprises a rectangular piece of thin pliant sheet-like material such as fabric which is drawn through and about the wall of said sleeve into an open-ended annular tubular configuration wherein a first pair of opposite edges of the sheet material encircle said wheel axis in contiguous relation to one another and a second pair of opposite edges of the sheet material encircle said annular center line in contiguous relation to one another, and stitching joining the contiguous edges, whereby said tube has a first annular row of stitching about said axis and a second annular row of stitching about said centerline.

6. A toy according to claim 5 wherein:

said first stitching row is disposed in close surrounding relation to said central wheel opening, and an ornamental disc on the outer end of said axle covering said first stitching row.

7. A toy according to claim 5 wherein:

said sheet material has a dark portion which forms the outer wall portion of said tube to simulate a tire tread and a light portion which forms the remaining wall portion of said tube to simulate the side walls.

8. A toy according to claim 1 wherein:

said toy comprises a toy wheeled vehicle having a simulated vehicle body, front and rear axles, and front and rear wheels on said axles.

9. A wheel for a wheeled toy comprising:

a hollow thin-walled pliant toroidal tube having a central opening with an axis and bounded circumferentially by an inner annular wall portion of said tube, a cylindrical sleeve contained within the interior of said tube in surrounding relation to said inner wall portion, said sleeve being sufficiently rigid to provide a bearing for an axle of said wheeled toy, said tube being formed of a piece of material extended through the sleeve and with opposite contiguous edges of the material joined and encircling the axis of the central opening, and a pliant stuffing material filling said tube interior about said sleeve.

10. A toy according to claim 9 wherein:

the wall of said tube comprises a thin flexible fabric material.

11. A toy according to claim 9 wherein:

said stuffing material comprises a relatively soft spongy cotton material.

12. A toy according to claim 11 wherein:

the wall of said tube comprises a thin flexible fabric material.

13. A wheel for a wheeled toy comprising:

a hollow thin-walled pliant toroidal tube having a central opening bounded circumferentially by an inner annular wall portion of said tube, a relatively rigid sleeve contained within the interior of said tube in surrounding relation to said inner wall portion, said tube having an annular center line and comprising a rectangular piece of thin pliant sheet-like material such as fabric which is drawn through and about the wall of said sleeve into an open-ended annular tubular configuration wherein a first pair of opposite edges of the sheet material encircle the axis of said central wheel opening in contiguous relation to one another and a second pair of opposite edges of the sheet material encircle said annular center line in contiguous relation to one another, and stitching joining the contiguous edges, whereby said tube has a first annular row of stitching about said axis and a second annular row of stitching about said centerline, and a pliant stuffing material filling said tube interior about said sleeve.

14. A toy according to claim 13 wherein:

said sheet material has a dark portion which forms the outer wall portion of said tube to simulate a tire tread and a light portion which forms the remaining wall portion of said tube to simulate the side walls.

15. The method of fabricating a wheel for a wheeled toy comprising the steps of:

selecting a relatively rigid sleeve and a rectangular piece of thin pliant sheet-like material, drawing said sheet material through and about the wall of said sleeve into an open-ended annular tubular configuration having an annular centerline and wherein a first pair of opposite edges of the sheet material encircle the axis of said sleeve in contiguous relation to one another and a second pair of opposite edges of the sheet material encircle said annular centerline in contiguous relation to one another, stuffing with a relatively soft spongy material the annular interior space formed by said tubular configuration, and joining the first pair of contiguous edges of said tubular configuration and joining the second pair of contiguous edges to form a hollow thin-walled pliant torodial tube filled with said stuffing material and containing said sleeve with the sleeve disposed in surrounding relation to the inner annular wall portion of said tube.

16. The method of claim 15 wherein:

said sheet material comprises fabric, said stuffing material comprises cotton, and said contiguous edges are joined by stitching.

* * * * *